United States Patent [19]

Orth

[11] Patent Number: 4,468,054

[45] Date of Patent: Aug. 28, 1984

[54] FLANGE MOUNTED THERMOSTATIC EXPANSION VALVE

[75] Inventor: Charles D. Orth, Lake Forest, Ill.

[73] Assignee: The Singer Company, Stamford, Conn.

[21] Appl. No.: 438,802

[22] Filed: Nov. 3, 1982

[51] Int. Cl.[3] ..... F16L 39/00; F16L 41/00

[52] U.S. Cl. ..... 285/137 R; 285/189; 285/208; 285/211

[58] Field of Search ..... 285/137 R, 189, 208, 285/211, 368

[56] References Cited

U.S. PATENT DOCUMENTS 3,869,152 3/1975 De Vincent et al. ..... 285/137 R
3,869,153 3/1975 De Vincent et al. ..... 285/137 R
3,929,356 12/1975 De Vincent et al. ..... 285/137 R X

FOREIGN PATENT DOCUMENTS 6397 of 1915 United Kingdom ..... 285/137 R
328056 4/1930 United Kingdom ..... 285/137 R

*Primary Examiner*—Richard J. Scanlan, Jr.
*Attorney, Agent, or Firm*—David L. Davis; Robert E. Smith; Edward L. Bell

[57] ABSTRACT

The inlet and outlet tubes on each side of the valve body are connected to the valve body by a notched plate engaging the shoulder upset from the tube. The upset forms a metal-to-metal seal against the seat in the body while the O-ring engages the wall of the flared section of the inlet leading to the smaller bore which receives the end of the tube.

1 Claim, 2 Drawing Figures

FLANGE MOUNTED THERMOSTATIC EXPANSION VALVE

BACKGROUND OF THE INVENTION

This invention relates to mounting a thermostatic expansion valve (TXV) in an air conditioning system. The TXV is generally the type shown in U.S. Pat. No. 3,537,645 which is well suited to automotive air conditioning systems. Automotive systems are basically assembled in the vehicle and ease of assembly is an important factor. The valve shown in said patent required four threaded connections which require assembly time and extra material in the body for the threads.

SUMMARY OF THE INVENTION

The object of this invention is to provide a simplified mounting arrangement for a thermostatic expansion valve. This mounting arrangement permits reduction in the size, weight and cost of the TXV. It can be assembled into an air conditioning system faster and the mount itself weighs less.

DETAILED DESCRIPTION OF THE DRAWINGS

Figure 2:
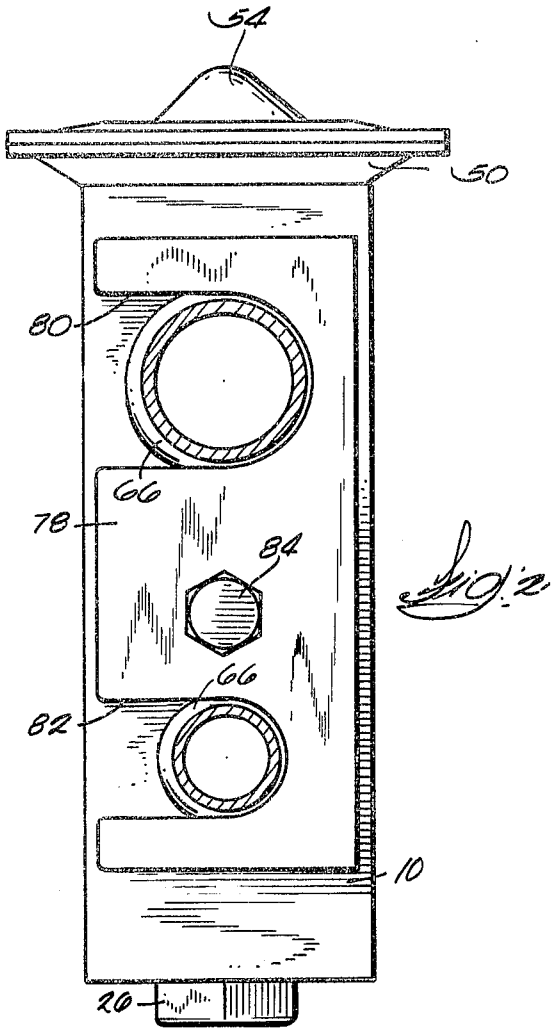
FIG. 2 is a side elevation of FIG. 1 showing the shape of the flange plate.

The lower portion of valve body 10 is provided with inlet 12 and outlet 14 separated by a partition through which port 16 is provided to supply refrigerant to the space below the partition. Ball type valve 18 cooperates with seat 20 to control flow from the inlet to the outlet. The ball is centered on pad 22 which is urged in the valve closing direction by spring 24 compressed between the pad and carrier 26 threaded into the end of the valve body and adjustable to change the spring force. "O" ring 38 seals the carrier/valve body joint.

Valve 18 is actuated by push pin 30 which, in turn, is actuated by diaphragm rider pin 32 fixed to diaphragm pad 34 and having an end projection projecting through the pad and diaphragm 36 to communicate with head chamber 38. Pin 30 has a close sliding fit in bore 40 to minimize leakage along this portion since any such leakage would constitute a bypass. Sleeve 62 has a close sliding fit in bore 41 to minimize leakage and O-ring 43 seals against leakage between pin 32 and the inside of sleeve 62.

In the upper portion of the valve body, there is a return conduit including inlet 42 connected to the outlet of the evaporator E while outlet 44 is connected to inlet of compressor C. It will be appreciated that, as usual, the output of the compressor is fed into condenser K and thence to receiver R which is connected to the inlet 12 of the valve body 10. Pressure within the return conduit can communicate with chamber 46 below the diaphragm through the clearance between sleeve 62 and the hole through partition 48 in the upper wall of the valve body. Diaphragm 36 is mounted between domed head 54 and support cup 50 threaded into the upper end of the valve body and sealed with respect thereto by means of O-ring 52. Head chamber 38 is charged with a temperature responsive charge through capillary tube 56 which is then sealed off.

It will be noted that rider pin 32 is provided with a blind hole 58 which terminates approximately at the midpoint of the return flow path through the upper portion of the valve body. The blind hole, in effect, provides a small temperature sensing chamber 60 inside the rider pin and located in the system return path. Pin chamber 60 will always be colder than head chamber 38 and therefore the refrigerant charge will tend to condense in chamber 60 and the control point will be at this point which is ideally situated. Sleeve 62 is of a low thermal conductivity material to damp the response to chamber 60 to temperature change.

In order to make the valve mountable in all positions, capillary restrictor 64 is fitting in the upper end of the rider pin. This provides a very small capillary hole connecting rider pin chamber 60 to head chamber 38. This is adequate for transfer of pressure changes but will minimize migration of any condensed refrigerant charge in chamber 60 to the head chamber should the valve be mounted upside down. Without this restrictor there could be such migration with the result that the liquid refrigerant migrating to the head chamber (which is warmer) would flash to a gas (increasing the pressure) and then promptly be recondensed in chamber 60. This, of course, would induce hunting in the system. The restrictor minimizes hunting.

The hollowed out rider pin creating chamber 60 in the return flow path achieves outstanding response characteristics since it is positioned directly in the return flow path at the very point where the temperature should be controlled. Low conductivity sleeve 62 damps the response characteristics and keeps the chamber 60 at an average temperature while the restrictor 64 allows the valve to be mounted in any position without hurting the response characteristics by reason of unwanted migration of condensed refrigerant from chamber 60 to head chamber 38.

Figure 1:
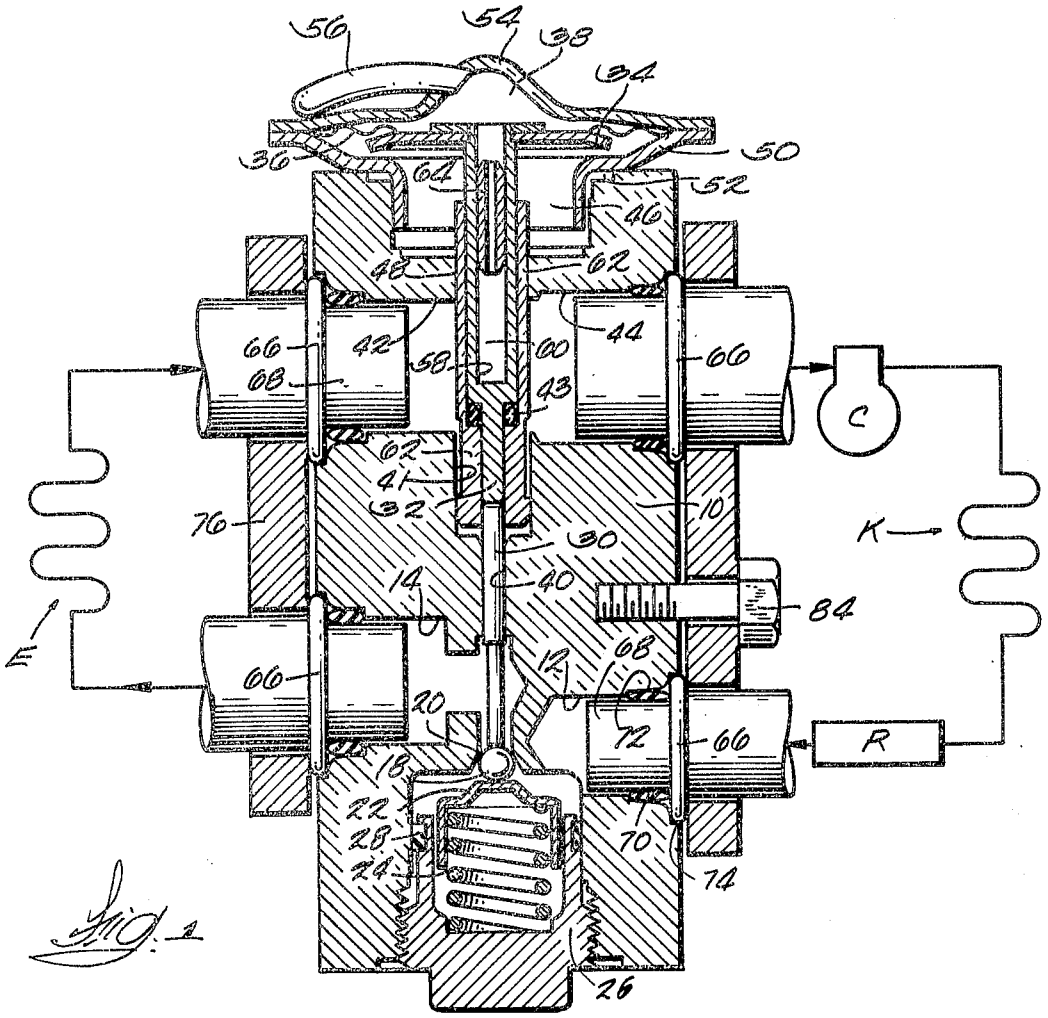
FIG. 1 is a vertical section through the TXV with the ends of the system tubes mounted into the valve body.

The foregoing description is generally the same as said patent but the patented valve body had threaded inlets and outlets. The present valve body has inlets and outlets which can receive fittings similar to the well-known "tube O" fittings. Thus, each tube has an upset 66 between the normal tube diameter and the reduced diameter end 68 which fits into the smallest bore of the inlet or outlet to capture the O-ring 70 in the slightly enlarged and flared bore 72. The flared bore 72 terminates in a shoulder or seat 74 against which upset 66 seats and provides a metal-to-metal seal. The tubes on each side of the body are held in assembled position by flange plates 76, 78. Taking plate 78 as representative, the plate has two notches 80, 82 to fit over the outlet tube and inlet tube, respectively, with the radiused corners of the notches bearing against the upset 66 to hold it tight against the seat 74. A single screw 84 holds the flange plate 78 on the body. The plate can't turn since the notches engaging the tubes prevent turning the plate. This manner of connecting the tubes is fast and very satisfactory. It requires less width of the body 10 as viewed in FIG. 1 since no allowance for threads in the body is necessary. The prior threaded connection required a body width about equivalent to the combinded width of the body and the flange plates 76, 78 in FIG. 1. Cost of this body is obviously less.

The notch method of engaging the upset on the tube is a different way of engaging the upset. Normally, "tube O" fittings include a nut captured back of the upset and threaded into the body to which connection is being made. The flange plate cannot be captured by the upsets and the notched engagement is a neat and quick solution.

The arrangement of the notches in the flange plate allows for quick and easy assembly. It is noted from FIG. 2 that the notches open on the same edge of the flange plate and extend inwardly from that edge in parallel alignment. Accordingly, to install the tubes, the tubes with their surrounding O-rings are inserted in their respective bores. The flange plate is then fitted over the tube upsets by a simple translatory motion with the tubes in their respective notches. The screw is then tightened to pull the flange plate toward the valve body and complete the assembly.

I claim:

1. A valve having a body including a plurality of ports each having a seat area surrounding a section leading to a bore, a plurality of tubes each having an end fitting snugly in a respective bore, each of said tubes having an upset spaced from said end and seated on said seat area, a plurality of O-rings each between a respective end and a respective upset of a respective tube and engaging a respective section of a respective bore, a plate having a plurality of notches each fitting over a respective tube and engaging a respective upset, all of said notches opening on the same edge of said plate and extending inwardly from said edge in parallel alignment, and a screw holding the plate on said body to retain said plurality of tubes.

* * * * *